United States Patent [19]

Welch

[11] Patent Number: 4,886,046

[45] Date of Patent: Dec. 12, 1989

[54] MOTOR CONTROL CIRCUIT FOR AN EYE LEVEL RANGE

[75] Inventor: Raymond L. Welch, Grand Prairie Township, Marion County, Ohio

[73] Assignee: Whirlpool Corporation, Benton Harbor, Mich.

[21] Appl. No.: 112,449

[22] Filed: Oct. 26, 1987

[51] Int. Cl.[4] ..... F24C 15/20

[52] U.S. Cl. ..... 126/299 D; 126/299 R; 219/10.55 R; 219/10.55 B; 219/400; 98/42.04; 236/49

[58] Field of Search ..... 126/21 R, 21 A, 299 R, 126/299 D, 300, 301, 302, 303; 98/42.04; 219/10.55 R, 10.55 B, 400; 236/93 R, 49

[56] References Cited

U.S. PATENT DOCUMENTS

| | | | |
|---|---|---|---|
| 3,109,358 | 11/1963 | Meyer | 126/299 D |
| 3,889,100 | 6/1975 | Dills | 219/400 X |
| 4,180,049 | 12/1979 | Carr et al. | 219/400 X |
| 4,191,875 | 3/1980 | Cunningham | 219/343 X |
| 4,327,274 | 4/1982 | White et al. | 126/299 D X |
| 4,539,469 | 9/1985 | Gigandet | 219/400 X |

FOREIGN PATENT DOCUMENTS

| | | | |
|---|---|---|---|
| 2518750 | 11/1976 | Fed. Rep. of Germany | 126/299 D |
| 0014027 | 1/1985 | Japan | 126/299 D |
| 2002106 | 2/1979 | United Kingdom | 126/299 D |

*Primary Examiner*—Robert E. Garrett
*Assistant Examiner*—Carl D. Price
*Attorney, Agent, or Firm*—Wood, Dalton, Phillips, Mason & Rowe

[57] ABSTRACT

A cooking apparatus including an eye level range includes a vent system for exhausting heated air and providing cooling a range electrical control components. A manual off, low, high selector switch is operable to operate a blower fan motor. A thermostat switch is provided for sensing a high temperature adjacent a compartment housing the electrical controls of the range unit in order to automatically turn the fan on to its high speed when a preselected high temperature is sensed.

8 Claims, 3 Drawing Sheets

MOTOR CONTROL CIRCUIT FOR AN EYE LEVEL RANGE

BACKGROUND OF THE INVENTION

1. Field Of The Invention

This invention relates generally to cooking apparatuses, and more particularly, to an improved ventilation system for cooking apparatuses.

2. Background Of The Invention

In one conventional form, a cooking apparatus, such as a range, comprises an "eye level" apparatus including an upper cabinet having an oven cavity and a subjacent stove portion having an oven cavity and surface heating units. A separate hood is commonly mounted in the top section of the upper cabinet including a blower for exhausting heated air. However, such a blower arrangement does not adequately draw air away from rear surface burner units.

Electrical controls for the apparatus are located within the upper cabinet. An acceptable internal temperature must be maintained for these controls to prevent problems. If the heated air from the lower stove can be prevented from entering the upper oven when the upper oven is operating then certain problems can be prevented.

The present invention overcomes these problems of prior cooking devices, in a novel and simple manner.

SUMMARY OF THE INVENTION

In accordance with the present invention, a cooking apparatus is provided having an improved bi-level exhaust venting system.

Broadly, there is disclosed herein a ventilation system in a cooking apparatus having a cabinet defining an oven cavity above a subjacent stove portion having front and rear surface heating units. First inlet means associated with the upper cabinet, opening above the upper cabinet, are provided for conducting air from a forward portion of a space above the stove front surface heating unit. Similarly, second inlet means are provided associated with the upper cabinet, opening below the upper cabinet, for conducting air upwardly from the space above the rear surface heating units of the stove. Air flow means in communication with the first and second inlet means discharges air delivered from the inlet means.

The ventilation system comprises a blower disposed within the upper cabinet. The blower is in communication with an upper vent inlet panel located at a top front portion of the upper cabinet for conducting air upwardly exteriorly of the upper cabinet. One or more lower inlets are provided in a bottom wall of the upper cabinet for conducting air upwardly from adjacent the surface heating units. Suitable grease filters may be provided over each of the air inlets. Air ducts are provided behind opposing side walls of the upper cabinet for communicating air from the lower inlets to the blower. A suitable outlet is provided, as required, for exhausting discharge air from the blower.

The exhaust blower turns on automatically when the upper oven is operating and the heat from the lower stove is causing the temperature of the controls to approach an unacceptable level. Turning on the exhaust blower pulls much of the hot air generated by the stove up and through the blower exhaust duct system of the upper oven thereby reducing the temperature of the air entering the upper oven control area to maintain the upper oven control temperature at an acceptable level.

According to an alternative embodiment, it is an object of the present invention to provide a ventilation system and blower motor control operable to automatically operate the blower at high speed when a preselected high temperature is sensed.

In the alternative embodiment, a thermostat is provided to sense temperature of the upper oven cabinet above the surface heating units. The thermostat includes a switch electrically connected to a vent relay which is connected to the blower motor. When the preselected high temperature is sensed, the switch energizes the relay which turns the blower on high speed, regardless of whether the blower motor was previously off, or operating at a lower speed, to conduct air through the upper cabinet blower vent system to prevent overheating of control components therein.

Further features and advantages of the invention will readily be apparent from the specification and from the drawings.

DESCRIPTION OF THE PREFERRED EMBODIMENTS

Figure 1:
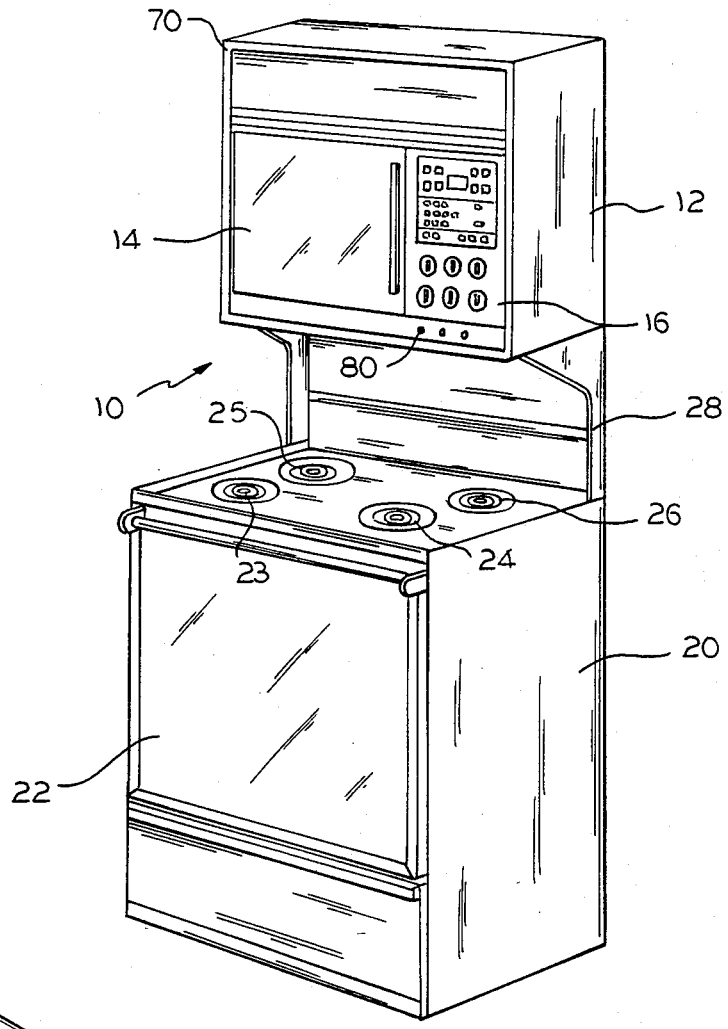
FIG. 1 is a perspective view of a cooking apparatus having a venting system embodying the invention.
Figure 2:
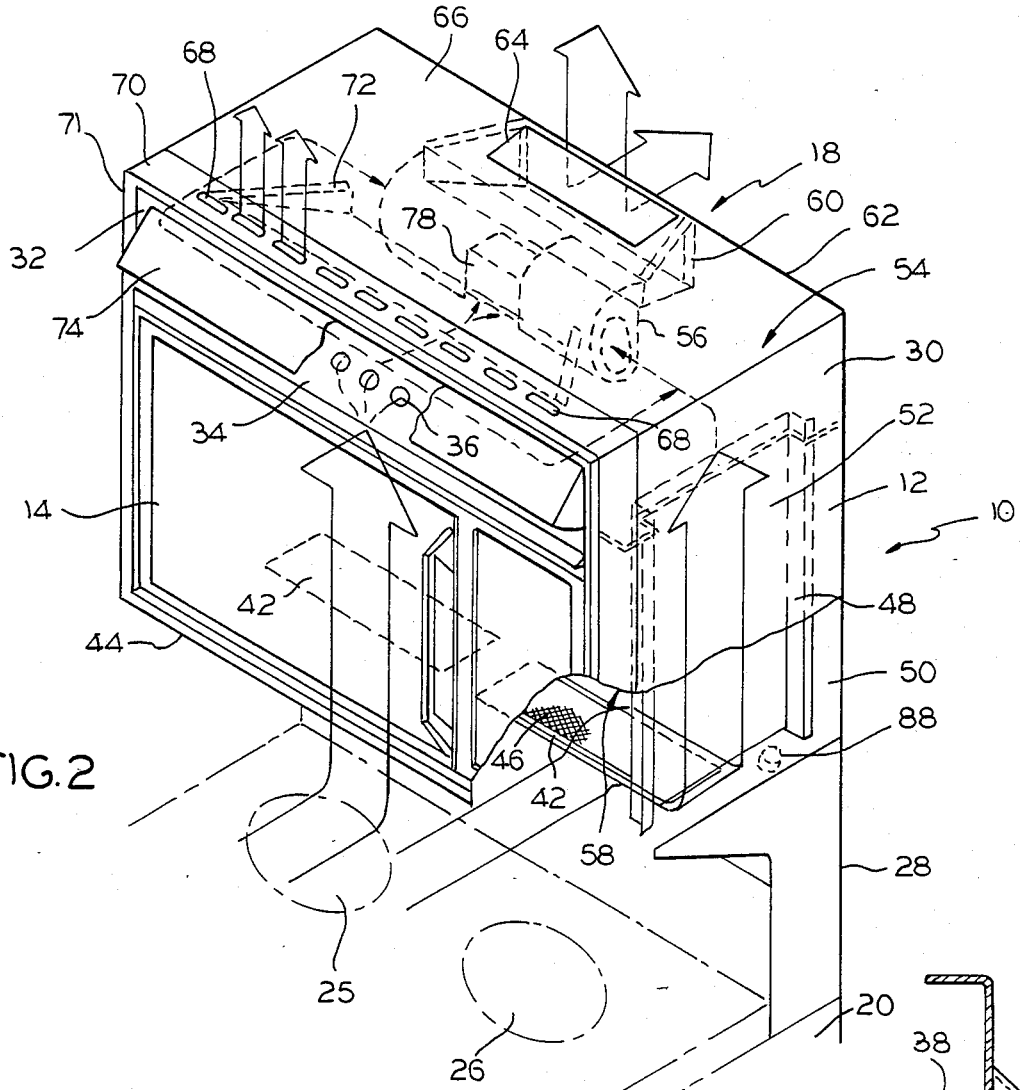
FIG. 2 is a partial perspective view of the cooking apparatus of FIG. 1 with parts broken away or shown in dashed lines.

Referring to FIGS. 1 and 2, a cooking apparatus 10 includes an upper cabinet 12 housing a microwave oven or conventional oven 14, an oven control panel 16 and its associated electrical components (not shown) and an improved ventilation system 18 In the illustrated embodiment, the upper oven 14 comprises a microwave oven.

The cooking apparatus 10 further includes a subjacent stove portion 20 defining a lower oven 22 and front and rear surface heating units 23–26. The upper cabinet 12 is spaced above the stove portion 20 by opposing side panels 28.

Figure 3:
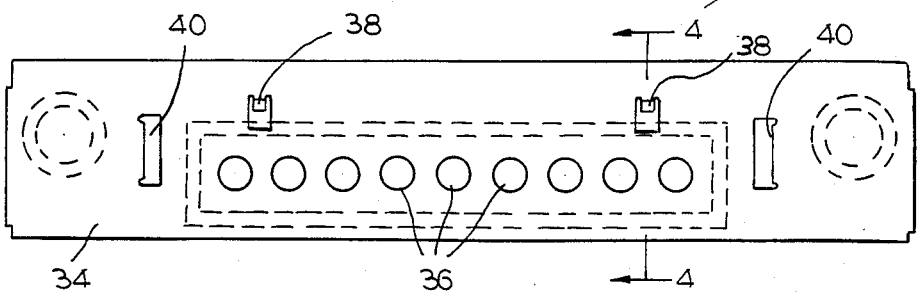
FIG. 3 is a detailed drawing of an upper vent panel of the oven of FIG. 1.
Figure 4:
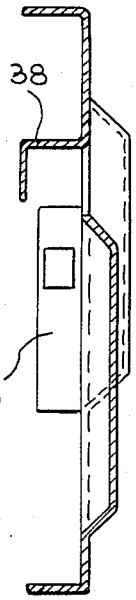
FIG. 4 is a sectional view taken along lines 4—4 of FIG. 3.

As best seen in FIG. 2, the ventilation system 18 comprises a hood 30 integral with and having a frame portion 32 of the upper cabinet 12 above the upper oven 14. The hood 30 includes a vent panel 34, shown in detail in FIGS. 3 and 4, defining a front wall thereof having a plurality of inlet openings 36 therein, above the upper cabinet 12 for conducting air upwardly exteriorly of the upper cabinet 12. Particularly, the upper inlet ports 36 conduct heated air radiating from the lower oven 22, the upper oven 14 and the front surface heater units 23 and 24. The vent panel 34 also includes upper tabs 38 and side tabs 40 for retaining a suitable grease filter (not shown).

A pair of lower, rectangular inlet ports 42 are provided in a bottom wall 44 of the upper cabinet 12. Again, suitable grease filters 46 are provided in the lower inlet ports 42. The lower inlet ports 42 conduct air upwardly from adjacent the rear heating units 25 and 26.

Figure 5:
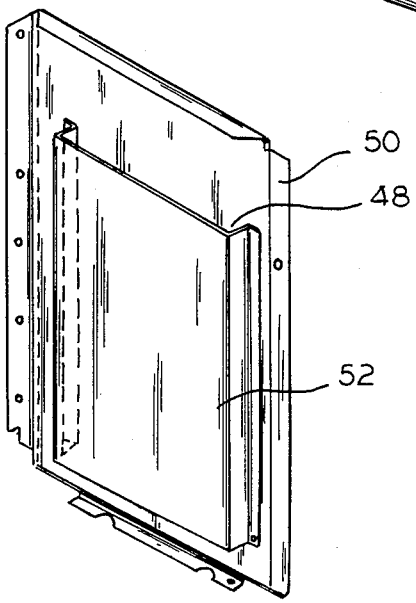
FIG. 5 is an inner view of an air duct and side panel assembly of the oven of FIG. 1.

Referring also to FIG. 5, an air duct 48 is formed between a side wall 50 and an inner U-shaped sheet metal panel 52. The duct 48 provides an air passageway from the lower inlets 42 upwardly towards an inner space 54 of the hood 30. A similar duct (not shown) is provided at the opposite side wall.

A centrifugal blower assembly 56 is housed in the hood space 54. The blower 56 is in communication with the upper inlet ports 36 and lower inlet ports 42 for drawing airflow therefrom. A motor driven fan 120 draws air from an internal control space 58 housing conventional electrical controls (not shown) for selectively energizing the cooking apparatus such as a transformers, relays and the like. Fan 120 circulates air through the control space 58 to ventilate the electrical controls, eliminating the requirement of a separate cooling fan.

The hood 30 may include any one of three different outlet ports according to the facilities provided where the device 10 is to be installed. For rear exhaust operation, an outlet port 60 is provided in a rear wall 62. For upper exhaust applications, an outlet port 64 is provided in a top panel 66 of the upper cabinet 12. Alternatively, a plurality of ports 68 are provided at a front portion 70 of a trim piece 71 for exhausting air into the room. According to the particular application, one of the three outlet ports is utilized, with the other two ports being provided with suitable obstructions to prevent airflow. Additionally, when the exhaust option to the front ports 68 is chosen, a baffle 72 is utilized for directing discharge air from the blower 56 to the ports 68.

A diverter door 74 is pivotally connected to the front trim piece 71 for providing selective access to the upper inlet ports 36. Accordingly, if the blower is energized and it is not necessary to draw air upwardly exteriorly of the upper cabinet, then the diverter door may be closed, and thus only the lower inlets 42 are utilized.

Figure 6:
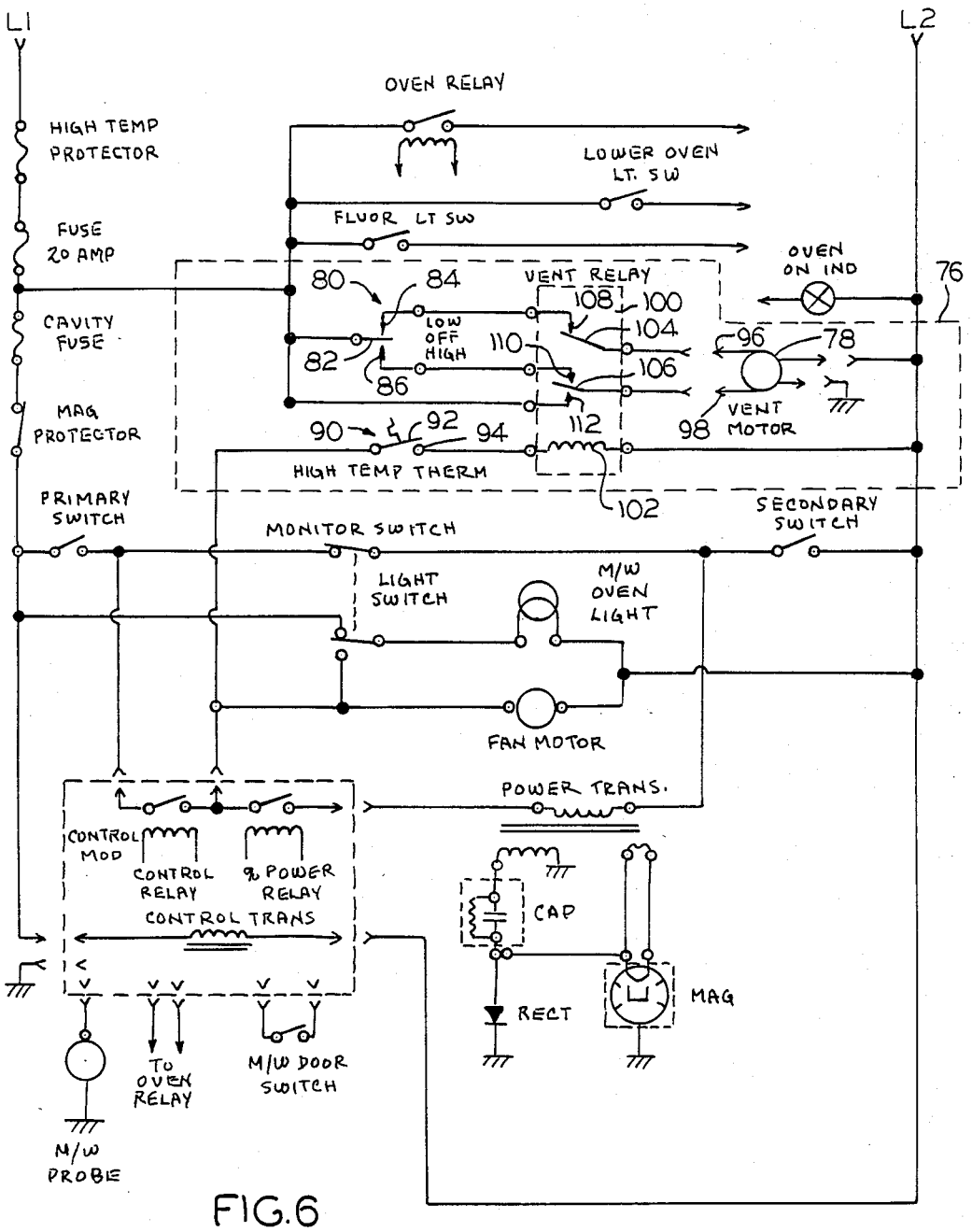
FIG. 6 is a control circuit for the cooking apparatus of FIG. 1 particularly illustrating a motor control circuit for a blower motor.

Thus, as described above, an eye-level range is provided with a bi-level exhaust system for improving exhaust ventilation of the air surrounding the cooking apparatus Referring to FIG. 6, an electrical schematic illustrates the electrical control circuitry for the cooking apparatus 10. Particularly, a motor control circuit 76 according to one embodiment of the invention is operable for controlling a blower or vent motor 78 for the blower 56. A three-position OFF/LOW/HIGH selector switch 80 is provided in the front trim piece 71 below the control panel 16. The vent switch 80 includes a movable contact 82 and first and second fixed contacts 84 and 86, respectively. The vent switch 80 is operable in any one of three positions, namely a central off position wherein the movable contact is spaced from both fixed contacts 84 and 86, a low speed position, wherein the movable contact 82 makes electrical contact only with the first fixed contact 84, and a high speed position wherein the movable contact 82 makes electrical contact only with the second fixed electrical contact 86.

A thermostat 88, see FIG. 2, senses the temperature at the bottom wall 44 of the upper cabinet 12 below the control space 58. Accordingly, the thermostat 88 particularly senses temperature adjacent the microwave electrical controls which might be caused by the microwave oven 14, lower oven 22 or the surface heating units 23–26. The thermostat 88 has a preselected high set temperature responsive to its sensed temperature. A thermostat switch 90 is associated with the thermostat 88 and includes a movable contact 92 and a fixed contact 94. When the preselected high temperature is sensed by the thermostat 88, the movable contact 92 makes an electrical contact with the fixed contact 94 to complete an electrical circuit. Otherwise, the movable control 92 and fixed contact 94 are spaced from one another.

In the preferred embodiment, the vent motor 78 is a two-speed motor operable at a relatively high or a relatively low speed. Accordingly, a low speed input terminal 96 is provided for selectively energizing the motor at a low speed, and a high speed input terminal 98 is provided for selectively operating the motor at a high speed.

A vent relay 100 includes a relay coil 102 and first and second movable contacts 104 and 106, respectively. The vent relay 100 also includes three fixed contacts 108, 110 and 112. If the relay coil 102 is de-energized, then the first movable contact 104 is in electrical contact with the first fixed contact 108, and the second movable contact 106 is in electrical contact with the second fixed contact 110. Conversely, when the relay coil 102 is energized, the first movable contact 104 is remote from the first fixed contact 108, and the second movable contact 106 is remote from the second fixed contact 110 and makes contact with the third fixed contact 112.

The thermostat switch 90 is coupled in series with the coil 102 between the power leads L1 and L2, for controllably energizing the coil 102 when the thermostat 88 senses the preselected high temperature and the microwave oven is energized through the control relay. The movable contacts 104 and 106 are electrically connected to the low and high speed terminals 96 and 98, respectively, of the vent motor 78. Additionally, the vent relay fixed contacts 108, 110 and 112 are electrically connected to the vent switch, first fixed contact 84, second fixed contact 86, and L1, respectively.

Thus, under normal conditions,. if the vent switch 80 is in the off position, there is no complete circuit to the vent motor 78, and the blower 56 remains off. If the vent switch 80 is placed in the low position, a completed circuit is provided from L1 through the vent switch movable contact 82 and fixed contact 84, the vent relay fixed contact 108 and movable contact 104 to the low speed terminal 96 of the vent motor 78 and L2 to operate the blower 56 at low speed. Similarly, if the vent switch 80 is placed in the high position, the circuit is completed from L1 through the vent switch movable contact 82 and second fixed contact 86, the vent relay second fixed contact 110 and second movable contact 106 to the high speed terminal 98 of vent motor 78 and L2 to operate the blower 56 at high speed.

If a high temperature is sensed by the thermostat 88, then a circuit is completed from L1 through microwave control relay, the movable and fixed contacts 92 and 94, respectively, of the thermostat switch 90, through the vent relay coil 102 to L2 causing vent relay movable contacts 104 and 106 to change position whereby a circuit is completed from L1 through microwave control relay, the vent relay third fixed contact 112 and the second movable contact 106 to the high speed terminal 98 of vent motor 78 and L2 to operate the blower 56 at high speed.

As may be understood from the above description, the thermostat switch 90 is operable upon sensing a high temperature and the microwave oven is operating to automatically switch the vent motor from either the off condition, or low speed condition, into a high speed operation in order to provide adequate cooling, to protect the microwave electrical components.

Figure 7:
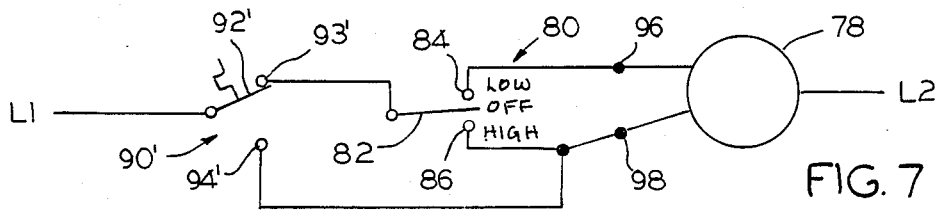
FIG. 7 is a motor control circuit for a blower motor according to an alternative embodiment of the invention.

Referring to FIG. 7, an alternative motor control circuit 76' for the vent motor 78 is illustrated wherein like components are indicated with like reference numerals and modified components are indicated with primed reference numerals.

In the alternative embodiment, a thermostat switch 90' includes a movable contact 92' connected directly to L1. The thermostat switch 90' also includes a first fixed contact 93' and a second fixed contact 94'. Under normal conditions, the movable contact 92' is in electrical contact with the first fixed contact 93'. If a high temperature is sensed by the thermostat 88, then the thermostat movable contact 92' is in electrical contact with the second fixed contact 94'.

The thermostat switch second fixed contact 94' is electrically connected to the vent switch second fixed contact 86 and the motor high speed terminal 98. The thermostat first fixed contact 93' is connected to the vent switch movable contact 82. The vent switch first switch contact 84 is connected to the vent motor low speed terminal 96. Thus, under normal conditions, with the vent switch 80 in the off position, no contact is made between L1 the vent motor 78, and the blower 56 remains off. If the vent switch 80 is placed in the low speed position, a circuit is completed from L1 through the thermostat switch movable contact 92' and first fixed contact 93', the vent switch movable contact 82 and the first fixed contact 84, and the vent motor low speed terminal 96 to L2 to energize the vent motor 78 and operate the blower 56 at low speed. Similarly, if the vent switch 80 is placed in the high position, a circuit is completed from L1 through the thermostat switch movable contact 92 and first fixed contact 93', the vent switch movable contact 82 and second fixed contact 86, and the vent motor high speed terminal 98 to L2 to operate the vent motor 78 to run the blower 56 at high speed. Regardless of the position of the vent switch 80, if the thermostat 88 senses the preselected high temperature, then the thermostat movable contact 92 makes electrical contact with the second fixed contact 94 to complete the circuit from L1 to the high speed terminal 98 of the vent motor 78 and L2 to energize the vent motor 78 and operate the blower 56 at high speed. Again, whether the vent switch is in the off position or low position, the thermostat energizes the vent motor 78 to operate the blower at high speed to cool the electrical components.

According to the latter alternative embodiment of the invention, a motor control circuit is provided which eliminates the need for a vent relay thereby simplifying the motor control circuit.

Thus, the invention broadly comprehends an improved ventilation system for a cooking apparatus.

The foregoing disclosure of the preferred embodiments is illustrative of the broad inventive concepts comprehended by the invention.

I claim:

1. In a cooking apparatus having a cabinet defining an oven cavity, wherein the cabinet is mounted above a source of heat, and wherein said cabinet houses control elements for said oven, the improvement comprising:

airflow means for conducting air through said cabinet, said airflow means defining a relatively high rate of airflow and a relatively low rate of airflow;

first control mean for commanding said airflow means to selectively provide no airflow, said relatively low rate of airflow, or said relatively high rate of airflow;

means for sensing temperature produced by said source of heat; and second control means coupling said sensing means and said airflow means for automatically operating said airflow means to operate at said high rate of airflow when said sensing means senses a preselected high temperature and wherein said airflow means cools said control elements when said preselected high temperature is sensed.

2. In cooking apparatus having a cabinet defining an oven cavity, a control space, an oven control housed in said space, and a blower having a two speed electrical motor for providing airflow to aid in cooling said oven control, an improved motor control comprising:

control means coupled to said motor for selectively de-energizing said motor, operating said motor at the first speed, or operating said motor at the second speed;

a thermostat having a preselected high set temperature, said thermostat being responsive to the temperature adjacent said oven control; and a thermostat switch electrically coupled to said motor to automatically initiate operation of said blower at the second speed upon said thermostat sensing said preselected high temperature.

3. The improved motor control of claim 2 wherein said blower is operable at a relatively high speed or a relatively low speed and said thermostat switch is operable to operate said blower at said high speed when said preselected high temperature is sensed by said thermostat.

4. The improved motor control circuit of claim 2 wherein said control means comprises a three position manual selector switch coupled to said blower, for operating said blower in a manual mode.

5. In a cooking apparatus having a cabinet defining an oven cavity, a control space, an oven control housed in said space, and a blower having an electrical motor for cooling said oven control, an improved motor control comprising:

a three position manual selector switch coupled to said blower, operating said blower in a manual mode;

a relay coupling said selector switch and said motor;

a thermostat having a preselected high set temperature, said thermostat being responsive to the temperature adjacent said oven control; and a thermostat switch electrically coupled to said motor to automatically initiate operation of said blower upon said thermostat sensing said preselected high temperature.

6. In a cooking apparatus having a cabinet defining an oven cavity, and a blower operated by a two speed motor for cooling the interior of said cabinet, a motor control circuit comprising:

a three position selector switch coupled to said motor having off, low and high positions for de-energizing said motor, operating said motor at a relative low speed, and operating said motor at a relatively high speed, respectively;

a thermostat having a preselected high set temperature, said thermostat being responsive to the temperature in the interior of said cabinet; and a thermostat switch coupled to said motor and said selector switch for automatically bypassing said selector switch to operate said motor at said high speed when said thermostat senses said preselected high temperature.

7. The motor control circuit of claim 6 further comprising a relay coupling said selector switch and said thermostat switch with said motor.

8. The motor control circuit of claim 7 wherein said relay includes a coil connected to said thermostat switch, and contact switches connected between said selector switch and said motor.

* * * * *